US006176693B1

(12) United States Patent
Conti

(10) Patent No.: US 6,176,693 B1
(45) Date of Patent: Jan. 23, 2001

(54) VOLUMETRIC BLOWER WITH COVERS HAVING A DUCT FOR CONNECTION TO THE DELIVERY MANIFOLD

(75) Inventor: Carlo Conti, Osnago (IT)

(73) Assignee: Finder Pompe S.p.A., Merate (IT)

( * ) Notice: Under 35 U.S.C. 154(b), the term of this patent shall be extended for 0 days.

(21) Appl. No.: 09/042,410

(22) Filed: Mar. 13, 1998

(30) Foreign Application Priority Data

Mar. 17, 1997 (IT) ..... MI97A0607

(51) Int. Cl.[7] ..... F04C 18/18
(52) U.S. Cl. ..... 418/180; 418/206.4
(58) Field of Search ..... 418/15, 75, 78, 418/180, 206.4

(56) References Cited

U.S. PATENT DOCUMENTS

| | | | | |
|---|---|---|---|---|
| 2,111,568 | | 3/1938 | Lysholm et al. . | |
| 2,489,887 | * | 11/1949 | Houghton | 418/180 |
| 4,215,977 | | 8/1980 | Weatherston | 418/1 |

FOREIGN PATENT DOCUMENTS

| | | | | |
|---|---|---|---|---|
| 865864 | * | 2/1953 | (DE) | 418/180 |
| 3238015 | * | 4/1984 | (DE) | 418/180 |
| 3318519 | | 11/1984 | (DE) . | |
| 309685 | | 4/1929 | (GB) . | |

* cited by examiner

*Primary Examiner*—John J. Vrablik
(74) *Attorney, Agent, or Firm*—Ladas & Parry

(57) ABSTRACT

Volumetric blower comprising an internally hollow body (11) for defining a compartment (12) which is placed in communication with an intake manifold (30) and a delivery manifold (31) and which has, arranged inside it, two rotors (20) which are parallel to a longitudinal axis (X—X) of the blower, counter-rotating and shaped in the manner of lobes (21) having a correlated profile and which are designed to produce, together with the internal wall **(11*a*) of said compartment, the periodic formation of a chamber (40) containing the fluid to be conveyed to the delivery manifold (31), the opposite openings in the longitudinal direction of said compartment (20) being closed by an associated cover (50), wherein the internal surface (51) of said covers (50) has, formed in it, at least one duct (52;152) arranged, with respect to the longitudinal axis (X—X), on the side corresponding to the delivery manifold (30) so as to allow connection of said chamber (40) to the delivery manifold itself and designed to be closed by the front surface (21*a*) of the lobes (21) of the associated rotor (20)** whenever each lobe passes opposite the duct itself.

8 Claims, 3 Drawing Sheets

VOLUMETRIC BLOWER WITH COVERS HAVING A DUCT FOR CONNECTION TO THE DELIVERY MANIFOLD

DESCRIPTION

The present invention relates to a volumetric blower comprising an internally hollow body forming a compartment which houses a pair of rotors and which is connected to an intake manifold and a delivery manifold, the opposite openings in the longitudinal direction of said compartment being closed by an associated cover having, formed on its internal surface, at least one duct arranged on the delivery side so as to allow connection of said chamber to the delivery manifold itself.

In the technical sector relating to compressors so-called volumetric blowers which are also referred to by the term "Roots" are known, said blowers being designed to deliver a gas throughput which is practically constant with variations in the pressure and operation of which does not involve a compression phase inside the compressor.

Said blowers essentially consist of a body having, formed inside it, a cylindrical compartment inside which two shafts comprising several lobes with a correlated profile rotate in opposite directions, said shafts, during rotation, cyclicly forming chambers delimited by two adjacent lobes of the same rotor and by the internal wall of said compartment.

Said chambers, as a result of the rotation of the lobes which delimit them, draw fluid from an intake manifold extending outside the body of the blower and placed in communication with said internal compartment and convey the volume of fluid contained in the chamber to a delivery manifold located opposite the intake manifold and in turn placed in communication with the blower compartment on th e opposite side of the rotors.

It is also known that the fluid compression phase occurs at the moment when the said chamber opens out towards the delivery manifold inside which a fluid with a pressure greater than the intake pressure is present, causing a flow-back towards the chamber which is a conveying the fluid from the intake to the delivery, causing compression of the fluid itself.

At the moment when the chamber opens out towards the delivery, however, in addition to the said compression, the flowback of the fluid al so causes the generation of shock waves and violent pressure pulsations which result in rapid dissipation of energy in the form of heat and noise.

In order to reduce drastically this noise phenomena, it is therefore necessary to make the compression phase as gradual as possible, by advancing and graduating opening of the chamber towards the delivery manifold.

For this purpose it is known, in the art of the sector, to form grooves of increasing depth in the direction of rotation of the rotors, in the internal wall of the said compartment housing the rotors.

Examples of this known art are described, for example, in DE 35 27 292 and in IT-1,264,069 which also envisage similar grooves, but having a smaller angular breadth, in the region of the intake manifold.

These grooves on the intake side essentially allow a delay in closing of the chamber formed by the lobes of the rotor with a consequent improvement in the volumetric efficiency of the blower. In addition to this, the specific angular extension of the grooves on the intake side and on the delivery side—the latter being much longer than the former—results, for a short period of time, in a direct connection between intake and delivery which is able to reduce further the said pulsations effects.

Despite the measures taken, the blowers of the known type still have drawbacks arising from the high noise level due to a poor distribution of the flows passing from the intake manifold to the delivery manifold, said poor distribution of the flows also being due to the interference effect caused by said grooves for advancing opening and delaying closing of the chambers.

In addition to this, the practical formation of said grooves on the internal surface of the compartment housing the rotors involves technical difficulties due to the machining difficulty and tolerances required which increase the overall cost of the blower and do not allow easy adaptation of the latter to the specific working conditions since, in order to vary the aperture of said grooves, it would be necessary to change the compressor body.

The technical problem which is posed, therefore, is that of providing a volumetric blower which, while maintaining a high efficiency and low manufacturing cost, is provided with means designed to reduce considerably the noise level and the pressure pulsations which are typical of blowers of the known type.

Within the scope of this problem, a further requirement is that said means for reducing the noise level should result in an improved distribution of the fluid flows from the intake to the delivery and should be easy to apply to blowers of the conventional type as well without the need for structural modifications of the body of the blower itself and, if necessary, should be able to be replaced in an easy and low-cost manner so as to adapt the blower to different working conditions.

These technical problems are solved according to the present invention by a volumetric blower comprising an internally hollow body for defining a compartment which is placed in communication with an intake manifold and a delivery manifold and which has, arranged inside it, two rotors which are parallel to a longitudinal axis of the blower, counter-rotating and shaped in the manner of radial lobes with a correlated profile and which are designed to produce, together with the internal wall of said compartment, the periodic formation of a chamber containing the fluid to be conveyed to the delivery manifold, the opposite openings in the longitudinal direction of said compartment being closed by an associated cover, wherein, the internal surface of said covers has, formed in it, at least one duct arranged, with respect to the longitudinal axis (X—X), on the side corresponding to the delivery manifold so as to allow connection of said chamber to the delivery manifold itself and designed to be closed by the front surface of the lobes of the associated rotor whenever each lobe passes opposite the duct itself.

Further details may be obtained from the following description of a non-limiting example of embodiment of the invention provided with reference to the accompanying drawings in which.

Figure 1:
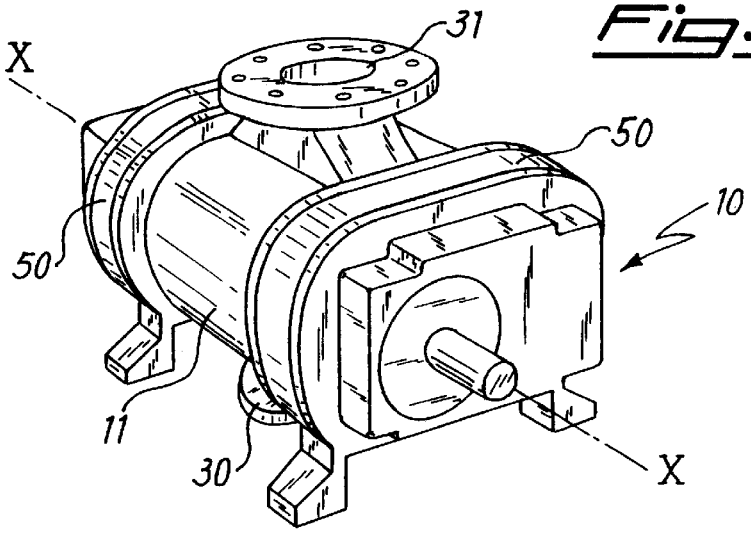
FIG. 1 shows a perspective view of the blower according to the invention.
Figure 2:
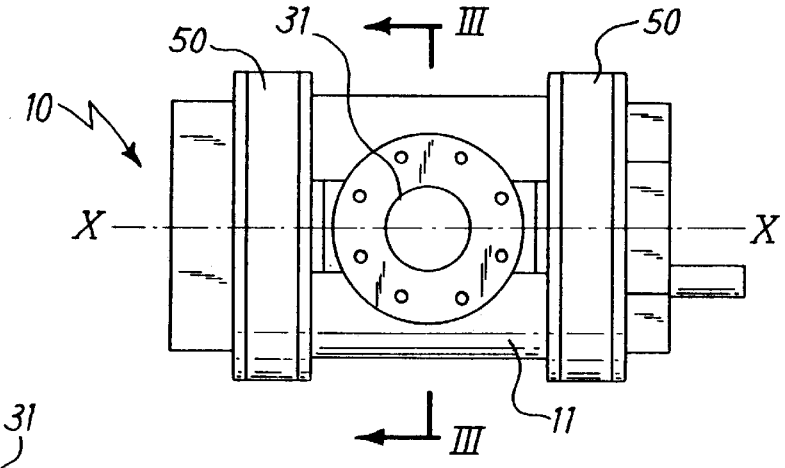
FIG. 2 shows a plan view of the blower according to FIG. 1.
Figure 3:
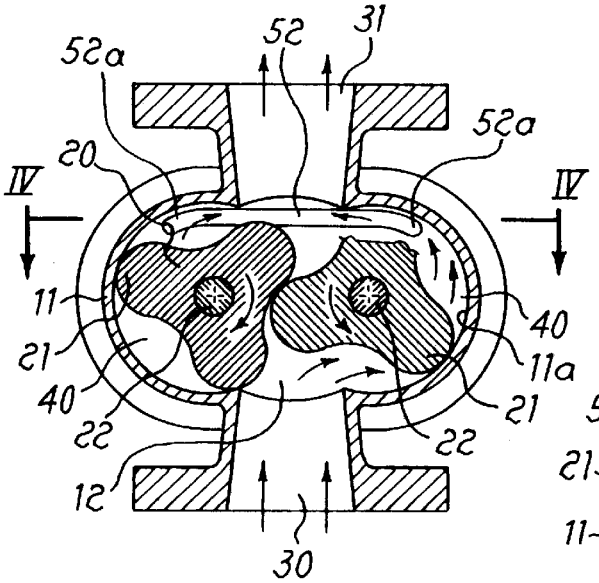
FIG. 3 shows a section along the plane indicated by III—III in FIG. 2.
Figure 3A:
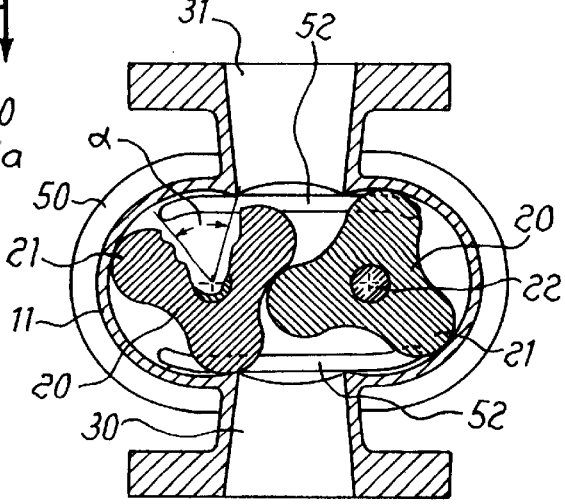
Figure 4:
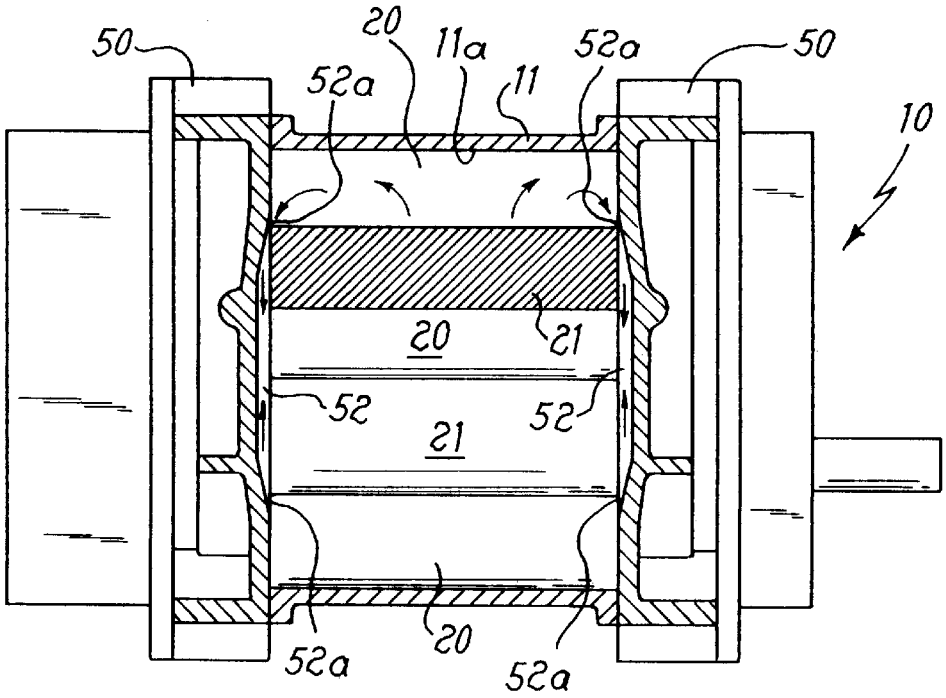
Figure 5:
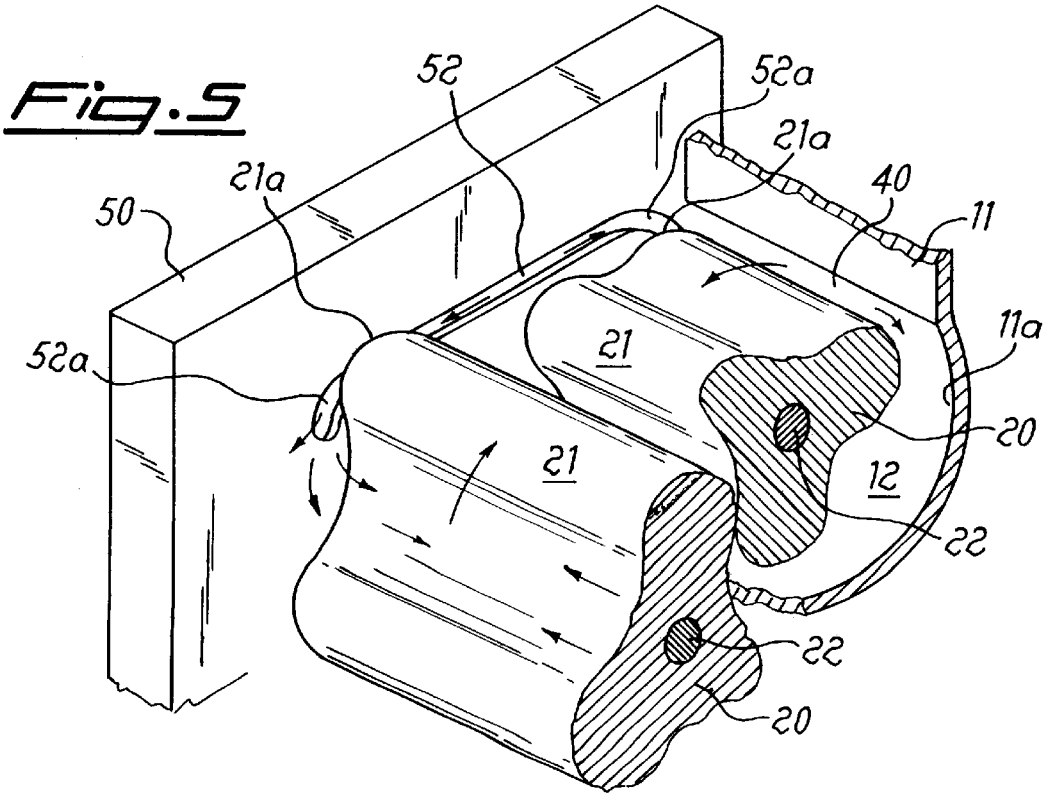
Figure 6A:
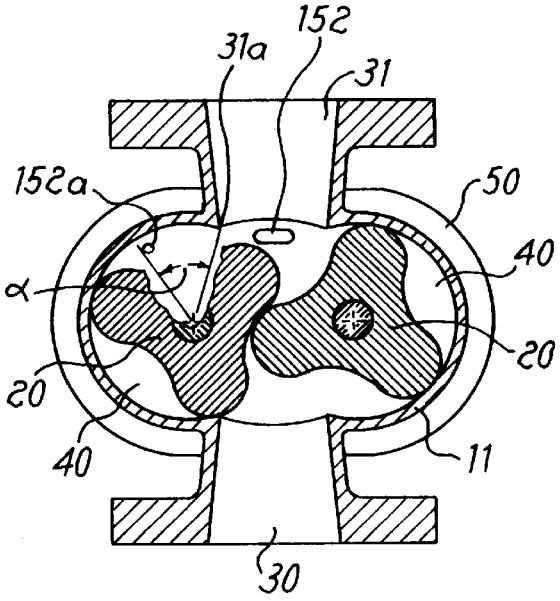
Figure 6B:
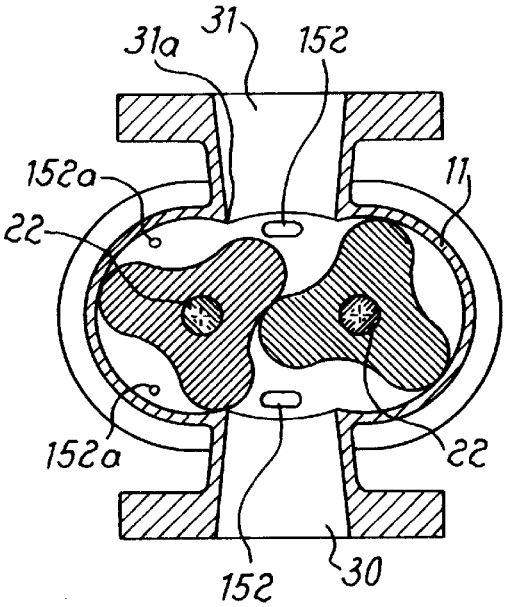
Figure 7A:
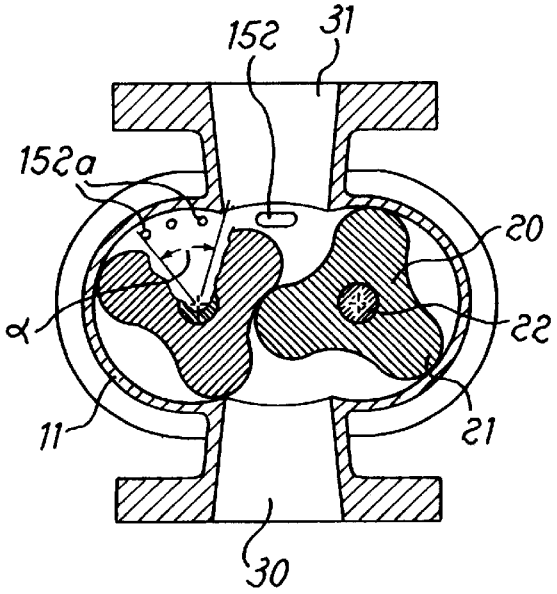
Figure 7B:
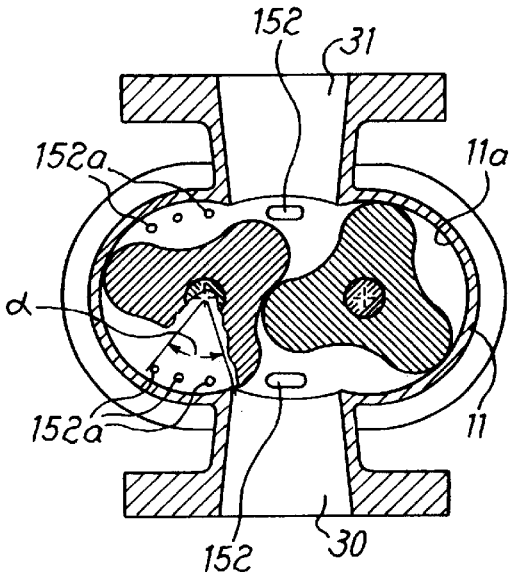

FIG. 3*a* shows a cross-section similar to that of FIG. 3 of a bidirectional blower according to the invention;

FIG. 4 shows a partial cross-section along the plane indicated by IV—IV in FIG. 3;

FIG. 5 shows a partial perspective view of the blower split in the zone of communication between rotor compartment and side cover;

FIGS. 6*a*, 6*b* show a cross-section similar to that of FIG. 3, illustrating a variation of embodiment of the ducts providing communication between chamber and manifold in a monodirectional and a bidirectional blower respectively, and;

FIGS. 7*a*, 7*b* show a cross-section similar to those of FIGS. 6*a*, 6*b*, illustrating a further embodiment of the ducts providing communication between chamber and manifold.

As shown, the blower 10 according to the invention comprises a body 11 which is elongated in the direction of the longitudinal axis X—X and internally hollow so as to form a compartment 12 housing a pair of rotors 20 which have three lobes 21 and which are mounted on shafts 22 made to rotate in opposite directions so that the rotors are counter-rotating.

Two manifolds 30 and 31 extend from the body 11 of the blower in a direction substantially perpendicular to said axis X—X, said manifolds being symmetrically arranged on opposite sides of the two rotors 20 and forming respectively the intake manifold and the delivery manifold.

The lobes 21 of the rotors 20 have correlated profiles so that, once arranged in phase, their rotation occurs without interference and in such a way as to produce the cyclical formation of chambers 40 delimited by two adjacent lobes 21 and by the internal surface 11*a* of the wall of the compartment 12; said chambers contain the volume of fluid drawn from the intake manifold and to be supplied to the delivery manifold.

The body 11 of the blower 10 is closed at the opposite longitudinal ends by a cover 50 which has, formed on its internal surface 51, a cavity 52 extending in a transverse direction with respect to the longitudinal axis X—X of the blower 10 and having a depth variable from a minimum at the opposite ends 52*a* to a maximum in the central zone thereof.

Said cavity 52 is formed in a position such that its ends 52*a* arranged on the opposite sides of the longitudinal axis X—X may be partially closed by the front surface 21*a* of the lobes 21 of the associated rotor 20, whenever the lobe itself passes opposite the said end.

In this way, the periodic passing movement of the said lobes causes closing/opening of the end zones of the cavity 52 and hence closing/opening of the connection between the chamber 40 containing the fluid volume and the delivery manifold 31 of the blower, allowing opening of the chamber 40 towards the delivery manifold 31 to be modulated and hence a reduction in the noise and pulsation phenomena due to the excessively rapid compression of the fluid which, as mentioned, occurs when the chamber 40 opens out into the delivery manifold 31.

In a preferred embodiment said cavity 52 have a central straight section and a substantially curved end section extending over an angular section comprised between 10° and 45° depending on the degree of advance in opening of the chamber 40 envisaged for the specific application.

As illustrated in FIG. 3*a*, the internal surface 51 of the cover 50 may also have a second cavity 52 arranged symmetrically with respect to the preceding one, but on the side of the intake manifold 30, making it possible to obtain a bidirectional blower since the two rotors may rotate indifferently in either direction.

FIG. 6*a* shows a further example of embodiment of the connection which allows advanced opening of the chamber into the delivery manifold; in this case, the cavity 52 has been replaced by a duct 152 cast in the inside part of the cover 50 and provided with at least one channel 152*a* opening into the inside surface 51 of the cover 50 and which, emerging inside the compartment 20 in a zone prior to that delimited by the delivery manifold 31, produces the advanced and gradual programmed opening of the chamber 40 into the manifold itself.

As shown in FIG. 7*a*, the formation of a plurality of channels 152*a* suitably emerging inside the compartment 20 and arranged at angular distances comprised between 10° and 45° with respect to the entry circumference 31*a* of the manifold 31 inside the compartment 20 allows the advance to be adjusted according to the specific application. For the sake of greater clarity, said angular distance has been indicated by the angle $\alpha$ in FIG. 7*a* (3*a*, 6*a*, 7*b*).

As shown in FIGS. 6*b* and 7*b*, the two variations of embodiment may also be symmetrically provided in the intake side so as to obtain a bidirectional blower.

It is therefore obvious how the blower according to the invention is able to solve the problem of noisiness and pressure pulsations in a low-cost and reliable manner; the formation of the grooves connecting together chamber and delivery manifold, in the side covers of the pump in fact results in an improved distribution of the fluid flows from the delivery manifold to the chamber between the lobes of the rotor, using the gas present in the latter as a means for pneumatically damping the two opposite-flowing streams of gas which, being cyclicly supplied from the grooves or channels present on the said side covers, implode inside the chamber itself. The effect of this damping action is a substantial reduction in the noise level compared to blowers of the known type.

In addition to this the blower according to the invention enables this silencing effect to be obtained independently of excessively precise tolerances and with the possibility of rapidly changing the covers themselves should variations in the size of the connection grooves be required.

With the symmetrical formation of the grooves themselves on the intake side and on the delivery side, finally, it is possible to obtain a bidirectional blower with obvious applicational advantages.

What is claimed is:

1. A volumetric blower comprising an internally hollow body for defining a compartment which is placed in communication with an intake manifold and a delivery manifold and which has, arranged inside it, two rotors which are parallel to a longitudinal axis of the blower, counter-rotating and shaped in the manner of lobes with a correlated profile and which are designed to produce, together with the internal wall of said compartment, the periodic formation of a chamber containing fluid to be conveyed to the delivery manifold, the opposite openings in the longitudinal direction of said compartment each being closed by an associated cover, characterized in that the internal surface of each of said covers has, formed in it, at least one duct means arranged, with respect to the longitudinal axis, on the side corresponding to the delivery manifold so as to allow connection of said chamber to the delivery manifold itself and designed to be closed by the front surface of the lobes of the associated rotor whenever each lobe passes opposite the duct itself and a second duct means similarly arranged at the intake manifold to allow connection to said chamber, to thereby enable bidirectional fluid flow through the blower.

2. Blower according to claim 1, characterized in that said duct means are symmetrically formed with respect to the longitudinal axis both on the intake side and on the delivery side so as to obtain a bidirectional blower.

3. Blower according to claim 1, characterized in that said duct means consists of at least one cavity extending in a transverse direction with respect to the longitudinal axis of the blower, the ends of said cavity being arranged on opposite sides with respect to the longitudinal axis of the blower.

4. Blower according to claim 3, characterized in that said cavity has a depth variable from a minimum at the opposite ends to a maximum in the central zone of the groove itself.

5. Blower according to claim 3, characterized in that said ends of the cavity are shaped in the manner of curved profiles extending over angular sections ($\alpha$) comprised of between 10° and 45°.

6. Blower according to claim 1, characterized in that said duct means is located inside the cover and emerges inside the compartment in a substantially central position and on the delivery side.

7. Blower according to claim 5, characterized in that said duct means has channels located inside the cover and emerging inside the compartment on opposite sides of the longitudinal axis of the blower.

8. Blower according to claim 6, characterized in that the angular distance ($\alpha$) between the position in which said channels emerge inside the compartment and the entry circumference of the delivery manifold inside the compartment itself is comprised of between 10° and 45°.

* * * * *